US005634705A

United States Patent [19]

Michino

[11] Patent Number: 5,634,705

[45] Date of Patent: Jun. 3, 1997

[54] STRUCTURE OF BULB MOUNTING PIECE FOR VEHICULAR LAMP

[75] Inventor: Makoto Michino, Shizuoka, Japan

[73] Assignee: Koito Manufacturing Co., Ltd., Tokyo, Japan

[21] Appl. No.: 434,054

[22] Filed: May 3, 1995

[30] Foreign Application Priority Data

May 10, 1994 [JP] Japan ..... 6-096276

[51] Int. Cl.[6] ..... F21V 31/00

[52] U.S. Cl. ..... 362/61; 362/267

[58] Field of Search ..... 362/267, 61; 277/165, 277/167.5, 184

[56] References Cited

U.S. PATENT DOCUMENTS

| | | | |
|---|---|---|---|
| 4,590,542 | 5/1986 | Schauwecker et al. | 362/61 |
| 4,623,958 | 11/1986 | Van Der Linde et al. | 362/61 |
| 4,631,651 | 12/1986 | Bergin et al. | 362/61 |
| 4,760,506 | 7/1988 | Mochizuki et al. | 362/226 |
| 4,764,854 | 8/1988 | Matsune et al. | 362/226 |
| 4,812,703 | 3/1989 | Kanematsu et al. | 313/318 |
| 4,841,419 | 6/1989 | Ohishi | 362/226 |
| 4,864,183 | 9/1989 | Okano | 313/318 |
| 4,922,398 | 5/1990 | Muto | 362/61 |
| 4,991,067 | 2/1991 | Nagengast | 362/61 |

*Primary Examiner*—Ira S. Lazarus
*Assistant Examiner*—Sara Sachie Raab
*Attorney, Agent, or Firm*—Sughrue, Mion, Zinn Macpeak & Seas

[57] ABSTRACT

A bulb mounting structure for a vehicular lamp having a reflector in which a bulb insertion hole is formed, the structure including a mounting piece for holding a bulb inserted into the bulb insertion hole, the mounting piece comprising a body having a disk-shaped engagement portion engageable with the bulb insertion hole, the disk-shaped engagement portion comprising a concave groove formed in an outer peripheral surface thereof; an elastic seal member received in the concave groove and being depressed against an inner peripheral surface of the bulb insertion hole; wherein a width of the concave groove is larger than a diameter of a cross-section of the elastic seal member.

18 Claims, 4 Drawing Sheets

STRUCTURE OF BULB MOUNTING PIECE FOR VEHICULAR LAMP

BACKGROUND OF THE INVENTION

1. Field of the Invention

The present invention relates to a bulb mounting structure for a vehicular lamp for mounting a mounting piece of the bulb in a circular bulb insertion hole formed in a reflector of the lamp through a ring-shaped elastic seal member.

2. Related Art

FIG. 8 shows a conventional structure of the type described above. As shown in FIG. 8, a reflector 1 is mounted within a headlamp, and a circular bulb insertion hole 2 is formed through a central portion of the reflector 1. A bulb 4 having a mounting piece (hereinafter referred to merely as "bulb") is mounted in the bulb insertion hole 2 through an O-ring 3. The bulb 4 is constituted by a bulb body 5 and a mounting piece body 6 formed of a synthetic resin for supporting the bulb body 5. The mounting piece body 6 includes a disk-shaped engagement portion 7 engageable with the bulb insertion hole 2, and a concave groove 7*a* is formed in an outer peripheral edge or surface of the disk-shaped engagement portion 7, and the O-ring 3 is received in the concave groove 7*a*.

A bayonet portion 8 is formed on and projects from the mounting piece body 6 whereas an engagement groove 9 for retainingly receiving the bayonet portion 8 is formed in an inner peripheral surface of the bulb insertion hole 2. The disk-shaped engagement portion 7 is inserted into the bulb insertion hole 2 and angularly moved or turned to engage the bayonet portion 8 in the engagement groove 9, thereby fixing the bulb 4 to the reflector 1.

When the bulb 4 is thus fixed relative to the bulb insertion hole 2, the O-ring 3 in the concave groove 7*a* is pressed against the inner peripheral surface of the bulb insertion hole 2, thereby sealingly closing a gap between the bulb insertion hole 2 and the bulb 4.

According to the above conventional structure, the width W of the concave groove 7*a* is substantially equal to the diameter D of a cross-section of the O-ring 3, as shown in FIG. 9, and therefore the contact pressure P applied to the compressed O-ring 3 against the inner peripheral surface of the bulb insertion hole 2 is so excessive that the bulb 4 is not smoothly attached and detached relative to the bulb insertion hole 2.

Furthermore, when the bulb 4 is inserted into the bulb insertion hole 2, a part of the O-ring 3 may protrude beyond an edge 7*b* of the concave groove 7*a* in a direction opposite to the direction of insertion of the bulb 4 as shown in FIG. 9, and the O-ring 3 may be lifted out of a bottom surface of the groove 7*b* as shown in FIG. 10. When the bulb 4 is turned to engage the bayonet 4 with the engagement groove 9, the protruding or the lifting of the O-ring 3 is promoted, so that the contact pressure applied by the O-ring 3 becomes uneven in the circumferential direction, thus causing the sealing effect to be unstable. Moreover, it is possible that a crack develops in the protruding portion of the O-ring 3 pressed against the edge 7*b* of the groove 7, and it is also possible that a gap is formed at the area of contact of the O-ring 3 because of the above lifting. As a result, the sealing of the bulb insertion hole 2 may be inadequate.

SUMMARY OF THE INVENTION

The present invention was made in view of the foregoing problems accompanying the conventional structure and, therefore it is an object of the present invention to provide a structure for mounting a bulb for a vehicular lamp having a mounting piece in which, capable of allowing the bulb to smoothly attach to and detach from a bulb insertion hole, so that a ring-shaped elastic seal member, disposed between the bulb and an inner peripheral surface of the bulb insertion hole, can ensure a seal therebetween.

The above and other objects can be achieved by a provision of a structure for mounting a bulb for a vehicular lamp having a mounting piece which, according to the present invention, includes a mounting piece a body of which is formed of a synthetic resin for supporting a body of the bulb; the mounting piece body having a disk-shaped engagement portion engageable with the bulb insertion hole; the disk-shaped engagement portion having a concave groove formed in an outer peripheral surface thereof; and a ring-shaped elastic seal member being received in the concave groove, and being pressed against an inner peripheral surface of the bulb insertion hole; wherein a width of the concave groove is made larger than a diameter of a cross-section of the elastic seal member, and a depth of the concave groove is made larger than a half of the diameter.

Preferably, the width of the channel-shaped groove is substantially equal to a dimension of the elastic seal member in a direction of the width of the groove when the elastic seal member is compressed upon mounting of the bulb in the bulb insertion hole.

When the disk-shaped engagement portion of the mounting piece is inserted into the bulb insertion hole, the elastic seal member is compressed and rubbed by the inner peripheral surface of the bulb insertion hole, and hence undergoes a force acting in a direction opposite to the direction of insertion of the disk-shaped engagement portion. However, the elastic seal member, received in the concave groove having the width larger than the diameter of the cross-section of the elastic seal member, is expanded in a direction of the width of the concave groove, so that the elastic seal member is kept received in the concave groove in a compressed condition without protruding out of the groove. Thus, in contrast to the conventional structure, the expansion of the elastic seal member in the direction of the width of the groove is not prevented by opposed side surfaces of the groove, and therefore a contact pressure produced by the elastic seal member will not become excessive, so that the contact pressure is uniform in the circumferential direction.

BRIEF DESCRIPTION OF THE DRAWINGS

FIGS. 4A and 4B are cross-sectional views showing the manner of compression (deformation) of the O-ring during the insertion of the bulb in the bulb insertion hole, and FIG. 4A showing an initial stage of the inserting operation while FIG. 4B shows an intermediate stage of this inserting operation;

DESCRIPTION OF THE PREFERRED EMBODIMENT

A preferred embodiment of the present invention will now be described with reference to the accompanying drawings.

Figure 1:
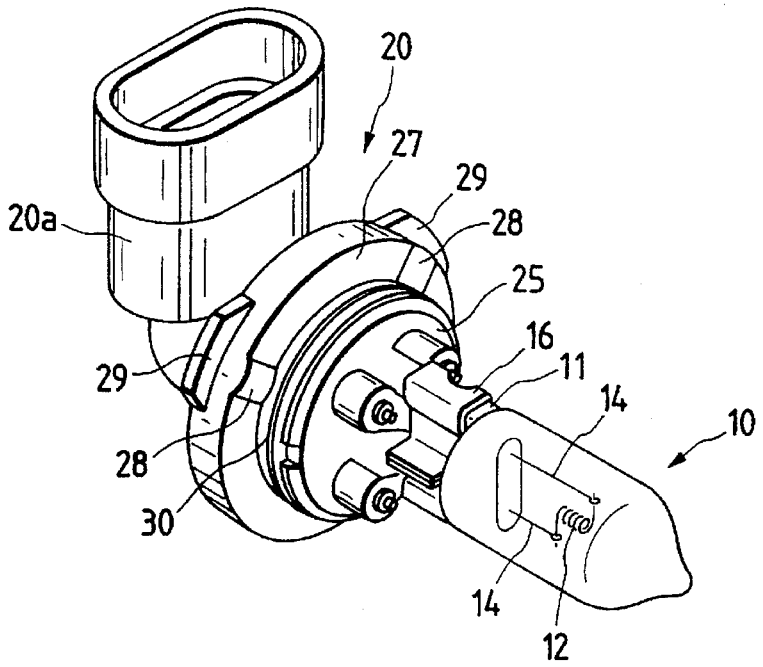
FIG. 1 is a perspective view of a preferred embodiment of a bulb having a mounting piece of the present invention serving as a light source for a headlamp of an automobile.
Figure 2:
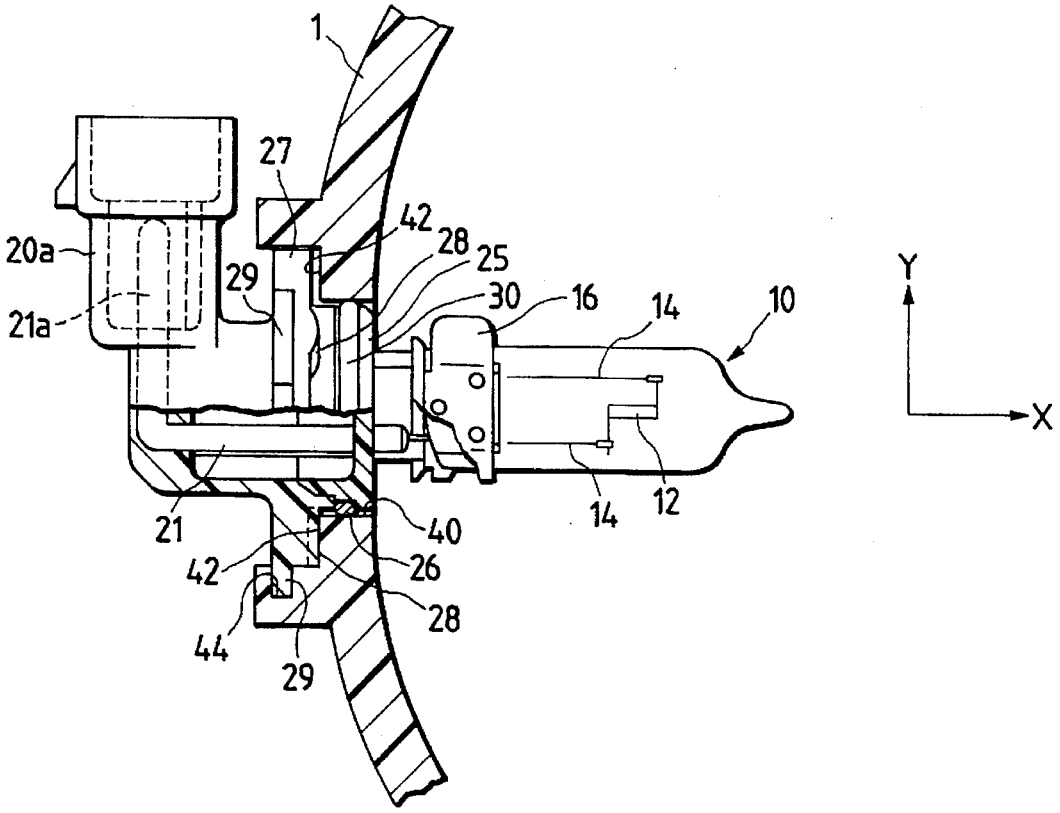
FIG. 2 is a cross-sectional view showing the bulb mounted in a bulb insertion hole of the headlamp.
Figure 3:
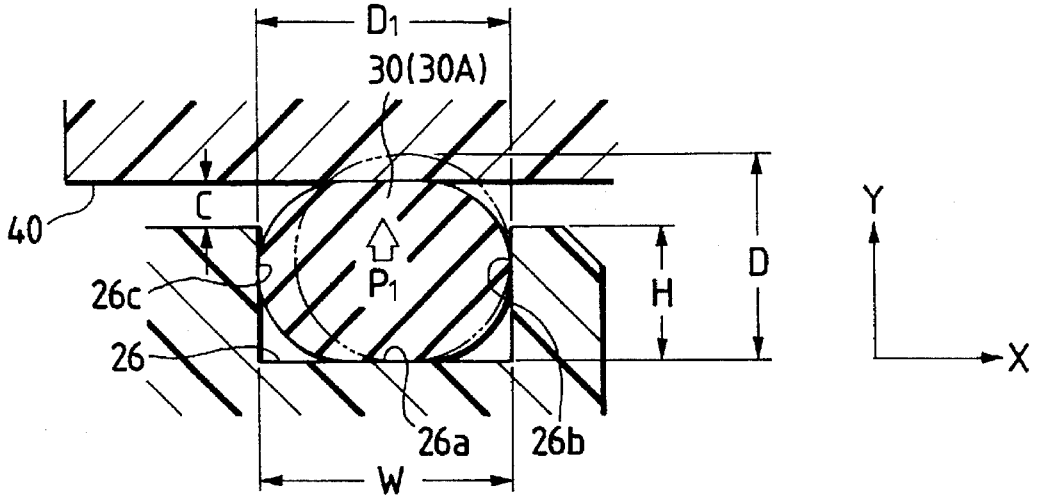
FIG. 3 is an enlarged, cross-sectional view showing an O-ring for sealing the bulb insertion hole.
Figure 4A:
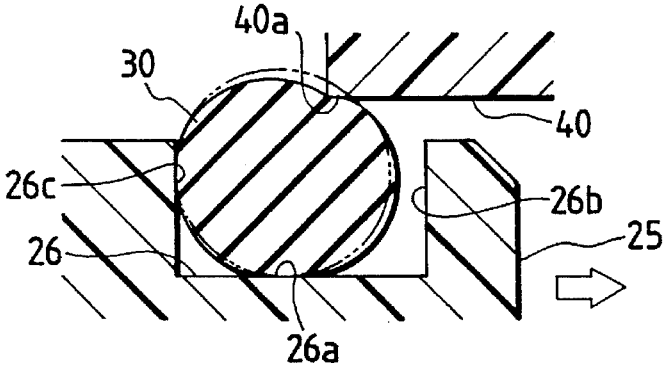
Figure 4B:
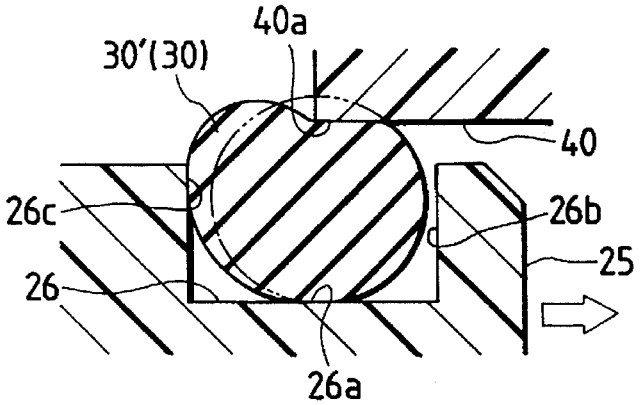
Figure 5:
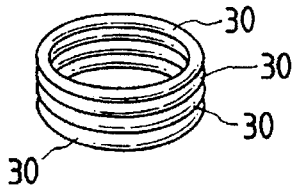
FIG. 5 is a perspective view showing conventional O-rings sticking to one another to be combined together.
Figure 6:
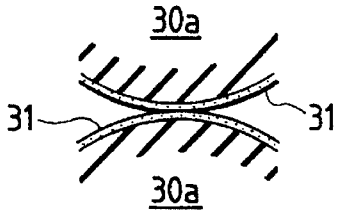
FIG. 6 is an enlarged, cross-sectional view showing a condition of bonding between the O-rings.
Figure 7:
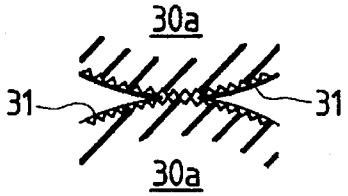
FIG. 7 is a cross-sectional view showing the surfaces of the O-rings of the embodiment on an enlarged scale.
Figure 8:
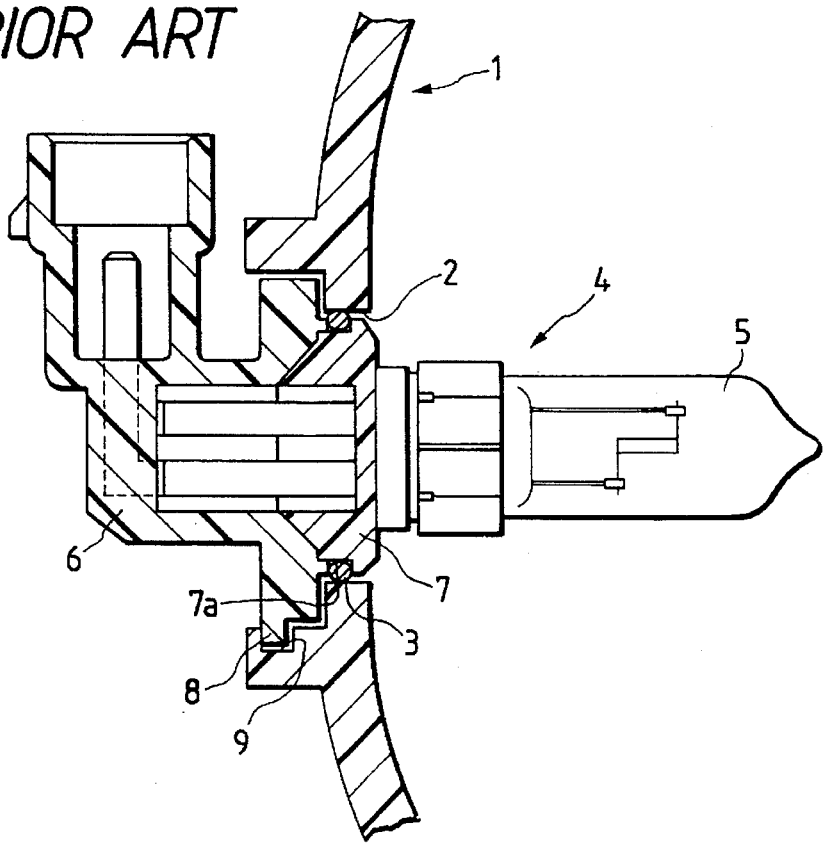
FIG. 8 PRIOR ART
FIG. 8 is a view showing a conventional bulb with a mounting piece.
Figure 9:
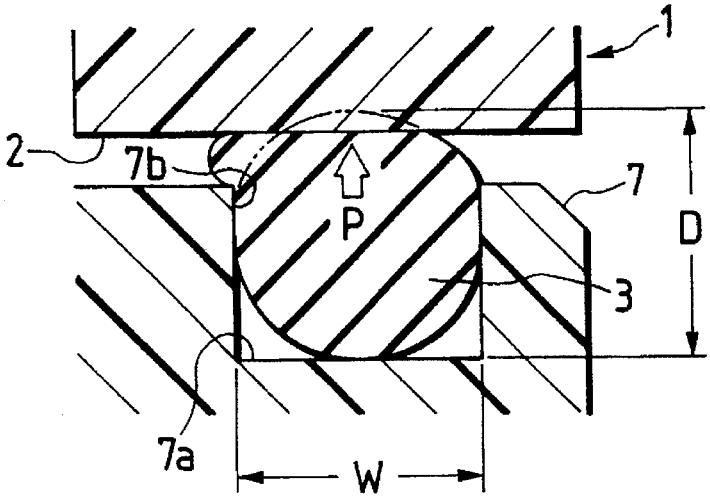
FIG. 9 PRIOR ART
FIG. 9 is a cross-sectional view showing a condition in which the conventional bulb is mounted in a bulb insertion hole in a reflector.
Figure 10:
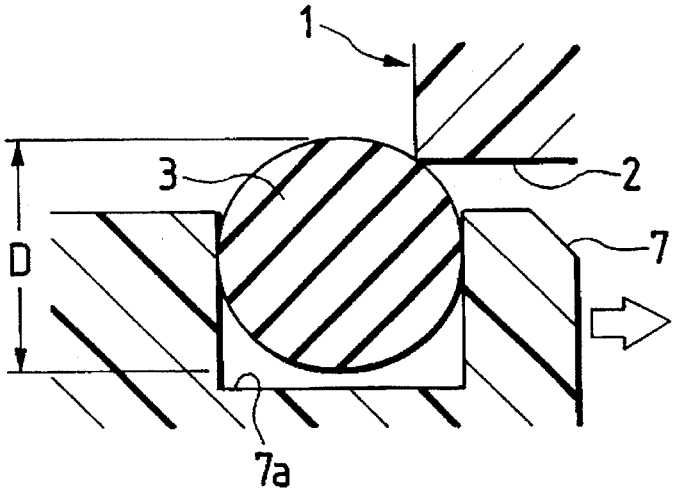
FIG. 10 PRIOR ART
FIG. 10 is a cross-sectional view showing a condition in which the conventional bulb is in the process of insertion into the bulb insertion hole.

FIGS. 1 to 7 concern a preferred embodiment of the invention. More specifically FIG. 1 is a perspective view of a bulb with a mounting piece serving as a light source for a headlamp of an automobile, FIG. 2 is a cross-sectional view showing the bulb mounted in a bulb insertion hole formed in a reflector of the headlamp, FIG. 3 is an enlarged, cross-sectional view showing an O-ring for sealing the bulb insertion hole, FIGS. 4A and 4B are cross-sectional views showing the manner of compression (deformation) of the O-ring during the insertion of the bulb into the bulb insertion hole, FIG. 5 is a perspective view showing conventional O-rings sticking to one another, FIG. 6 is a cross-sectional view showing bonding portions of the O-rings, and FIG. 7 is a cross-sectional view showing the surfaces of the O-rings of this embodiment on an enlarged scale.

A halogen bulb 10 (bulb body) has a filament 12 which is supported by a pair of lead supports 14. A mounting piece body 20 formed of a synthetic resin supports the bulb body 10. The mounting piece body 20 is provided with a holder plate 16 formed of metal fixedly mounted on a front end of the mounting piece body 20. The bulb body 10 and the mounting piece body 20 are integrally connected together by the holder plate 16 holding a pinch seal portion 11 formed at a rear end of the bulb body 10.

A pair of contact pieces 21 (only one piece is shown in FIG. 2) are integrally embedded in the mounting piece body 20 by insert-molding, and lead-out end portions of the lead support portions 14 extending from the pinch seal portion 11 at the rear end of the bulb body 10 are spot-welded to front ends of the respective contact pieces 21. Rear end portions 21*a* of the contact pieces 21 project into a tubular rear portion 20*a* of the generally L-shaped mounting piece body 20, thereby constituting a male connector.

The mounting piece body 20 has a disk-shaped engagement portion 25 formed at its front end for engagement in a bulb insertion hole 40, and also has a flange-like focal ring 27 formed at its front end portion for engagement with a peripheral edge portion of the bulb insertion hole 40 so as to limit the amount of insertion of the bulb into the bulb insertion hole 40. Three radially-extending ribs 28 of a sector-like cross-section are formed on a front surface of the focal ring 27, and are circumferentially spaced at equal intervals from one another. The ribs 28 are abutted against a reference abutment surface 42 formed on the peripheral edge portion of the bulb insertion hole 40, thereby positioning the bulb in the axial direction. Bayonet members 29 are formed on the outer periphery of the focal ring 27, and are disposed in registry with the ribs 28, respectively. The bayonet members 29 engage respectively with groove-like engagement portions 44 formed in the reflector 1 in the vicinity of the bulb insertion hole 40, thereby fixedly holding the bulb relative to the bulb insertion hole 40.

A concave groove 26 is formed in the outer peripheral surface of the disk-shaped engagement portion 25, and an O-ring 30 serving as an elastic seal member is received in the concave groove 26. The concave groove 26 is so dimensioned that the compressed O-ring 30 does not protrude out of the groove 26, and is held substantially in contact with a bottom surface 26*a* and opposed side surfaces 26*b* and 26*c* of the concave groove 26, as shown in FIG. 3. Namely, when the bulb is mounted in the bulb insertion hole 40, the O-ring 30 is compressed by the inner peripheral surface of the bulb insertion hole 40 and the bottom surface 26*a* of the concave groove 26, and is contracted in a direction Y (radial direction) and also expanded in a direction X (axial direction).

The width W of the concave groove 26 is substantially equal to the dimension $D_1$ (expansion dimension) of the thus compressed O-ring 30 in the direction X, and therefore the O-ring 30 is held substantially in contact with the opposed side surfaces 26*b* and 26*c* of the concave groove 26, so that a predetermined contact pressure $P_1$ is exerted between the bulb insertion hole 40 and the concave groove 26 uniformly over the entire circumference.

More specifically, at an initial stage of inserting the bulb into the bulb insertion hole 40, as shown in FIG. 4A, the O-ring 30 is pressed by an edge 40*a* of the bulb insertion hole 40, and is pressed against the side surface 26*c*. When the bulb is further inserted, as shown in FIG. 4B, the O-ring 30 is further depressed by the edge 40*a* of the bulb insertion hole 40, so that part 30' of the O-ring 30 is deformed and tends to protrude out of the concave groove 26. However, since the width W of the concave groove 26 is designed larger than the diameter D of the O-ring 30, the compressed O-ring 30 is expanded toward the side surface 26*b* , so that the whole of the O-ring 30 is received in the concave groove 26.

More preferably, where W represents the width of the concave groove 26, and D represents the diameter of a cross-section of the O-ring 30 in a non-compressed condition, the groove width W should preferably be in the following range:

$$D < W < \frac{5}{4} D$$

If the groove width W is smaller than the diameter D, it is possible that part of the compressed O-ring 30A protrudes out of the concave groove 26; however, if the groove width W is larger than the diameter D, there is little possibility that any portion of the O-ring 30A protrudes out of the concave groove 26, and therefore the contact pressure produced by the O-ring 30A is less uneven in the circumferential direction. Moreover, if the groove width W is designed equal to the dimension $D_1$ of the O-ring 30 compressed to be expanded in the direction X, the O-ring 30 is positively received in the concave groove 26, and therefore the contact pressure produced by the O-ring is uniform in the circumferential direction, thereby achieving a positive sealing effect. If the groove width W is more than (5/4)D, a relatively large gap is formed between the compressed O-ring 30A and the concave groove 26, and water and dust tend to reside in this gap. As a result, the deterioration of the O-ring 30A is accelerated, and also there is a fear that water and dust intrude into the inside of the reflector 1 (that is, into the lamp) through the area of pressurized contact between the O-ring 30A and the surface of the concave groove 26.

In order to prevent the O-ring 30 from being displaced out of the concave groove 26 and also to provide an appropriate contact pressure between the bulb insertion hole 40 and the concave groove 26, the depth H of the groove 26 should preferably be in the following range:

$$\frac{1}{2} D < H < \frac{3}{4} D$$

Namely, if more than a half of the height of cross-section of the O-ring 30 in a non-compressed condition is disposed outwardly of the concave groove 26, the O-ring 30 is liable to be dislodged from the concave groove 26. Therefore, in order to prevent the O-ring 30 from displacement out of the concave groove 26, it is preferred that at least a half of the height of cross-section of the O-ring 30 should be received in the concave groove 26. Therefore, the groove depth H is designed more than (½)D. On the other hand, a clearance C defined by the inner peripheral surface of the bulb insertion hole 40 and the outer peripheral surface of the disk-shaped engagement portion 25 (to which the concave groove 26 is open) is set constant and, therefore, if the groove depth H is more than (¾)D, the amount of protrusion of the O-ring 30 from the concave groove 26 is small, and hence the contact pressure (sealing force) produced by the O-ring is small. Therefore, in order to obtain the predetermined contact pressure $P_1$, it is preferred that the groove depth H is designed to be less than (¾) D.

On the other hand, the O-ring 30 is made of silicone, and satinizing is applied to the surface of the O-ring so that a plurality of O-rings 30 stacked one upon another will not stick to one another, thus facilitating the handling of the O-rings. More specifically, in the molding of the O-ring, a release agent 31 is used to facilitate the removal of the molded O-ring from a mold. The release agent 31 is deposited on the surface of the molded O-ring body 30*a*, and therefore when the O-rings are stacked one upon another, or when supplying the O-rings by a parts feeder, the layers of release agent 31, deposited respectively on the surfaces of the adjacent O-ring bodies 30*a*, stick to each other by adsorption as shown in FIG. 6, so that the O-rings 30 are combined together as shown in FIG. 5. Thus combined O-rings 30 can not be handled easily, and can not be smoothly supplied by a parts feeder.

In the afore-described embodiment of the invention, however, the satin finish is applied to the surface of the O-ring body 30*a*, and therefore fine projections of the satinized surfaces of the adjacent O-ring bodies contact each other, so that the overall area of contact between the layers of release agent 31 on these O-ring bodies is smaller. Therefore, the O-rings 30 will not stick to one another, and hence can be handled easily, and the O-rings can be supplied smoothly by a parts feeder.

For satinizing the surface of the O-ring, fine pits and projections are formed on surfaces of the O-ring forming mold by sandblasting or the like, and when the O-ring is molded using this mold, the satin finish is formed the surface of the O-ring.

As described above, according to a bulb mounting structure for vehicular lamp of the present invention, during the time when a disk-shaped engagement portion of a bulb body is inserted into the bulb insertion hole, an elastic seal member is compressed and expanded in the direction of the width of the concave groove to be kept received in the concave groove, thereby producing the proper contact pressure uniformly in the circumferential direction to effectively seal the bulb insertion hole. Therefore, the bulb can be smoothly attached to and detached from the bulb insertion hole, and also the bulb insertion hole can be positively sealed.

What is claimed is:

1. A bulb mounting structure for a vehicular lamp having a reflector in which a bulb insertion hole is formed, comprising:

a mounting piece for holding a bulb inserted into the bulb insertion hole, said mounting piece comprising a disk-shaped engagement portion engageable with the bulb insertion hole, said disk-shaped engagement portion comprising a concave groove formed in an outer peripheral surface thereof; and an elastic seal member received in said concave groove and being depressed against an inner peripheral surface of the bulb insertion hole;

wherein a width of said concave groove is larger than a diameter of a cross-section of said elastic seal member and substantially equal to a dimension of said elastic seal member in a direction of the width of said groove when said elastic seal member is compressed upon mounting of said bulb in the bulb insertion hole.

2. The bulb mounting structure according to claim 1, wherein a relationship in dimension of the width of said concave groove and the diameter of the cross-section of said elastic seal member satisfies the following equation, $$D < W < \frac{5}{4} D$$

where W represents the width of said concave groove, and D represents the diameter of the cross-section of said elastic seal member.

3. The bulb mounting structure according to claim 1, wherein said concave groove of said mounting piece has a depth which is larger than a half of the diameter of said cross-section of said elastic seal member.

4. The bulb mounting structure according to claim 3, wherein a relationship in dimension of the depth of said concave groove and the diameter of the cross-section of said elastic seal member satisfies the following equation, $$\frac{1}{2} D < H < \frac{3}{4} D$$

where H represents the depth of said concave groove, and D represents the diameter of the cross-section of said elastic seal member.

5. The bulb mounting structure according to claim 1, wherein said elastic seal member comprises an O-ring formed of silicone.

6. The bulb mounting structure according to claim 5, wherein said elastic seal member is subjected to a satinizing treatment.

7. The bulb mounting structure according to claim 1, wherein said mounting piece is formed of a synthetic resin.

8. The bulb mounting structure according to claim 1, wherein said disk-shaped engagement portion of said mounting piece engages with said bulb insertion hole by means of bayonet portions.

9. A vehicular lamp comprising:

a lamp body;

a reflector mounted in a lamp body;

a bulb insertion hole formed in said reflector;

a bulb mounted in said bulb insertion hole;

a bulb mounting piece for holding said bulb comprising a disk-shaped engagement portion engageable with said bulb insertion hole, said disk-shaped engagement portion comprising a concave groove formed in an outer peripheral surface thereof; and an elastic seal member received in said concave groove and being depressed against an inner peripheral surface of the bulb insertion hole;

wherein a width of said concave groove is larger than a diameter of a cross-section of said elastic seal member and substantially equal to a dimension of said elastic seal member in a direction of the width of said groove when said elastic seal member is compressed upon mounting of said bulb in the bulb insertion hole.

10. The vehicular lamp according to claim 9, wherein a relationship in dimension of the width of said concave groove and the diameter of the cross-section of said elastic seal member satisfies the following equation, $$D < W < \frac{5}{4} D$$

where W represents the width of said concave groove, and D represents the diameter of the cross-section of said elastic seal member.

11. The vehicular lamp according to claim 9, wherein said concave groove of said mounting piece has a depth which is larger than a half of the diameter of said cross-section of said elastic seal member.

12. The vehicular lamp according to claim 11, wherein a relationship in dimension of the depth of said concave groove and the diameter of the cross-section of said elastic seal member satisfies the following equation, $$\frac{1}{2} D < H < \frac{3}{4} D$$

where H represents the depth of said concave groove, and D represents the diameter of the cross-section of said elastic seal member.

13. The vehicular lamp according to claim 9, wherein said elastic seal member comprises an O-ring formed of silicone.

14. The vehicular lamp according to claim 13, wherein said elastic seal member is subjected to a satinizing treatment.

15. The vehicular lamp according to claim 9, wherein said mounting piece is formed of a synthetic resin.

16. The vehicular lamp according to claim 9, wherein said disk-shaped engagement portion of said mounting piece engages with said bulb insertion hole by means of bayonet portions.

17. A bulb mounting structure for a vehicular lamp having a reflector in which a bulb insertion hole is formed, comprising:

a mounting piece for holding a bulb inserted into the bulb insertion hole, said mounting piece comprising a disk-shaped engagement portion engageable with the bulb insertion hole, said disk-shaped engagement portion comprising a concave groove formed in an outer peripheral surface thereof; and an elastic seal member received in said concave groove and being depressed against an inner peripheral surface of the bulb insertion hole;

wherein a width of said concave groove is larger than a diameter of a cross-section of said elastic seal member, wherein said elastic seal member comprises an O-ring formed of silicon, and wherein said elastic seal member is subjected to satinizing treatment.

18. A vehicular lamp comprising:

a lamp body;

a reflector mounted in a lamp body;

a bulb insertion hole formed in said reflector;

a bulb mounted in said bulb insertion hole;

a bulb mounting piece for holding said bulb comprising a disk-shaped engagement portion engageable with said bulb insertion hole, said disk-shaped engagement portion comprising a concave groove formed in an outer peripheral surface thereof; and an elastic seal member received in said concave groove and being depressed against an inner peripheral surface of the bulb insertion hole; wherein a width of said concave groove is larger than a diameter of a cross-section of said elastic seal member, wherein said elastic seal member comprises an O-ring formed of silicon and wherein said elastic seal member is subjected to a satinizing treatment.

* * * * *